United States Patent [19]

Taylor

[11] 4,124,066

[45] Nov. 7, 1978

[54] RADIATOR SHUTTER FOR ARCTIC VEHICLES

[75] Inventor: Chester J. Taylor, Warren, Mich.

[73] Assignee: The United States of America as represented by the Secretary of the Army, Washington, D.C.

[21] Appl. No.: 756,162

[22] Filed: Jan. 3, 1977

[51] Int. Cl.[2] ..... F01P 7/10; F01P 11/20

[52] U.S. Cl. ..... 165/98; 123/41.04; 123/41.5; 123/41.58; 137/601; 251/61.1

[58] Field of Search ..... 123/41.04, 41.05, 41.06, 123/41.48, 41.49, 41.57, 41.58, 41.59, 41.5; 251/5, 61.1; 98/40 V, 40 VM; 137/601; 165/98, 99

[56] References Cited

U.S. PATENT DOCUMENTS

| | | | |
|---|---|---|---|
| 1,855,476 | 4/1932 | Edwards | 123/41.04 |
| 1,931,356 | 10/1933 | Porter | 165/98 |
| 2,291,283 | 7/1942 | Klein et al. | 123/41.05 |
| 3,011,518 | 12/1961 | Day et al. | 137/601 |
| 3,022,977 | 2/1962 | Jones | 251/61.1 |
| 3,760,779 | 9/1973 | MacLennan | 123/41.05 |
| 3,854,459 | 12/1974 | Stimeling | 123/41.04 |
| 3,900,299 | 8/1975 | Spehrley | 251/5 |

FOREIGN PATENT DOCUMENTS

| | | | |
|---|---|---|---|
| 960,325 | 2/1957 | Fed. Rep. of Germany | 137/601 |

*Primary Examiner*—Charles J. Myhre
*Assistant Examiner*—Sheldon Richter
*Attorney, Agent, or Firm*—Peter A. Taucher; John E. McRae; Nathan Edelberg

[57] ABSTRACT

A shutter mechanism for an engine radiator comprising a series of rigid porous tubes having elastomeric sleeves secured thereto. Introduction of pressurized fluid (e.g. compress air or engine coolant) into the porous tubes pressurizes the spaces between the tubes and sleeves, thereby causing the sleeves to balloon outwardly to fully or partly close the air supply passage leading to the radiator. Depressurization of the tube interior spaces allows the elastomeric sleeves to contract onto the tubes, thereby opening the radiator air passage system.

1 Claim, 10 Drawing Figures

RADIATOR SHUTTER FOR ARCTIC VEHICLES

The invention described herein may be manufactured, used, and licensed by or for the Government for governmental purposes without payment to me of any royalty thereon.

BACKGROUND AND SUMMARY OF THE INVENTION

Conventional radiator shutters for diesel truck engines comprise a series of pivotal vanes interconnected by parallelogram linkages. When the engine coolant temperature gets above a safe level an air-operated motor actuates the linkages to open the vanes; as the coolant temperature drops below a desired value the air-operated motor reverses the linkage motion to close the vanes. The vanes act like butterfly valves to control the air stream through the radiator.

When the vehicle is operated in arctic temperatures conventional shutters may have a tendency to "ice up" and stick in the open or closed position. The present invention provides a hollow flexible elastomeric vane structure that is internally pressurized to crack external ice accumulations, thereby preventing such ice accumulations from immobilizing the vanes in the open or closed positions.

THE DRAWINGS

FIG. 1 schematically shows an engine-radiator-shutter arrangement embodying this invention.

Figure 9:
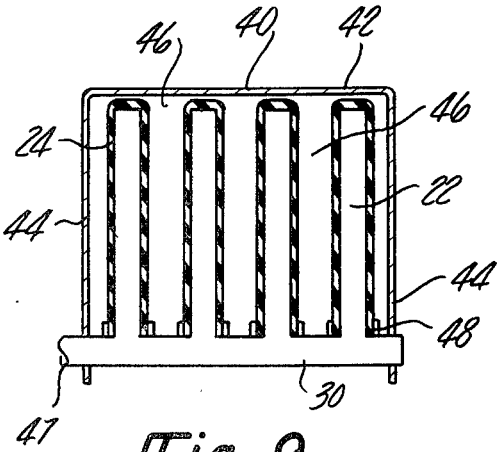
Figure 10:
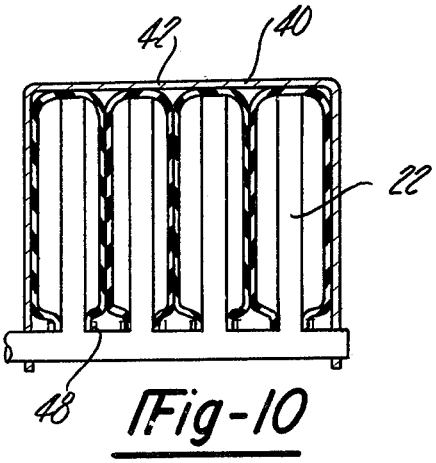

FIGS. 9 and 10 systematically illustrates another embodiment of the invention in its opened and closed conditions.

Figure 1:
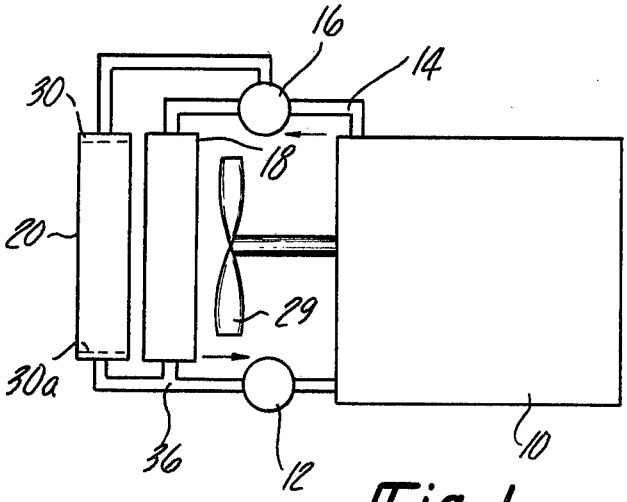

FIG. 1 illustrates a diesel or gasoline engine 10 used in an arctic military vehicle. This engine is cooled by a water-antifreeze solution pumped through the engine water jacket by a pump 12. The coolant exits from the engine through a line 14 that connects with a conventional bypass thermostat 16. At high coolant temperatures the thermostat directs the coolant into and through a conventional radiator 18. At low coolant temperatures thermostat 16 directs the coolant through a series of hollow tubes within a shutter mechanism 20; the tubes (not visible in FIG. 1) extend between inlet header 30 and outlet header **30*a***. The coolant flows through the radiator and shutter are in parallel flow relation, whereby the entire flow is through one or the other of these mechanisms, not simultaneously through both mechanisms. The aim is to have the shutter in an open condition at high coolant temperature conditions when the radiator is required to cool the coolant; at low coolant temperatures the aim is to close the shutter to air flow and also stop flow of coolant through the radiator. FIG. 1 is merely illustrative of one shutter control system; other control systems are possible. The invention relates to the shutter mechanism per se.

Figure 3:
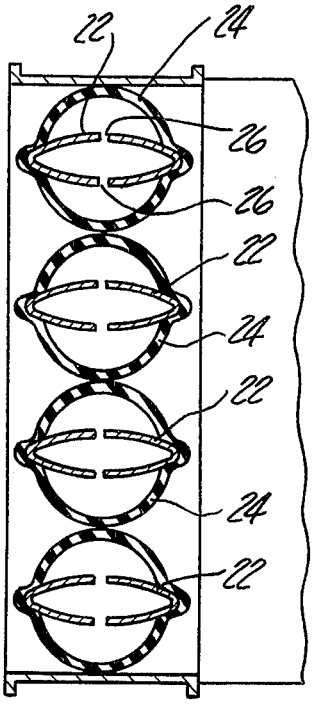
FIGS. 2 and 3 show the shutter of this invention in its open and closed positions.
Figure 2:
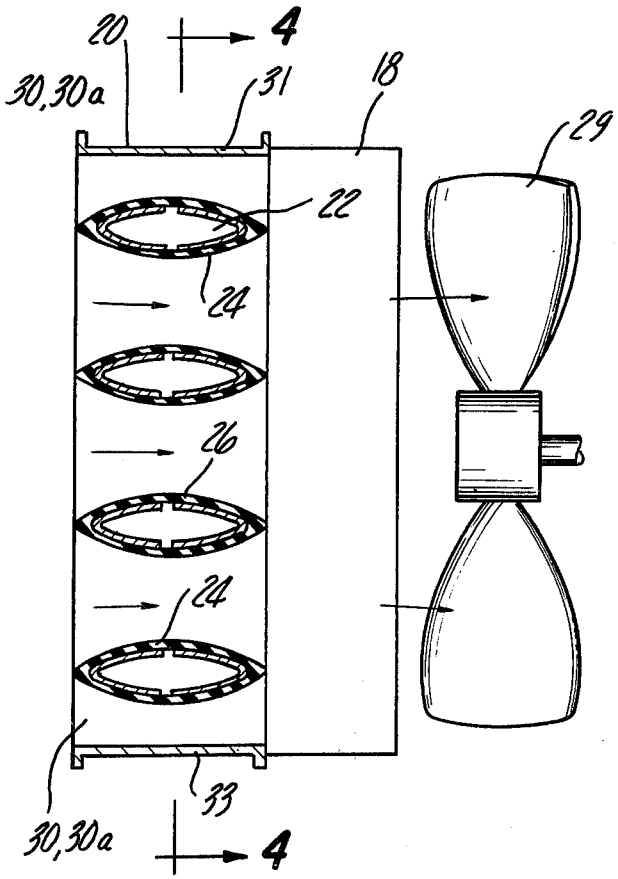

As seen in FIGS. 2 and 3 the shutter mechanism 20 comprises four elliptical flow tubes 22 extending between headers 30 and **30*a* transversely across the air stream designated by the wavy arrows. The air stream may be generated by a conventional engine-driven propeller fan 29 disposed at the outlet face of radiator 18. The shutter mechanism 20 is preferably located immediately upstream from the radiator; the face area for the radiator and shutter are approximately the same. Each rigid tube 22 in the shutter mechanism is encircled by an elastomeric sleeve 24 having the same length as the rigid tube. Each tube is provided with at least two rows of flow ports 26 in its laterally facing surface areas normal to the direction of air flow through the shutter mechanism. Pressurized fluid, such as liquid engine coolant or compressed air or pressurized oil from the lubrication system, is pumped through tubes 22** to operate the shutter mechanism.

Introduction of pressurized coolant or other fluid into each elliptical tube 22 enables pressure to be exerted through flow ports 26 and against the inner surfaces of the associated elastomeric sleeve 24, thereby causing the sleeve to balloon outwardly from the contracted condition of FIG. 2 to the expanded condition of FIG. 3. Such outward ballooning of the four elastomeric sleeves causes said sleeves to engage one another and thereby substantially interrupt air flow through the shutter and radiator 18. By reducing the pressure within each tube 22 it is possible to return the sleeves to the FIG. 2 contracted conditions, thereby permitting air flow through the radiator. Return of the sleeves from the FIG. 3 condition to the FIG. 2 condition is accomplished by elastomeric forces within each sleeve. Preferably each sleeve is tightly engaged with the tube so that outward stretching of the sleeve by the fluid pressure increases the internal stress within the elastomer and thereby conditions the sleeve for subsequent contraction against the tube.

Figure 5:
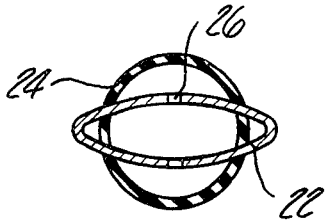
FIG. 5 illustrates the condition of an elastomeric sleeve prior to its placement on a rigid porous tube.
Figure 8:
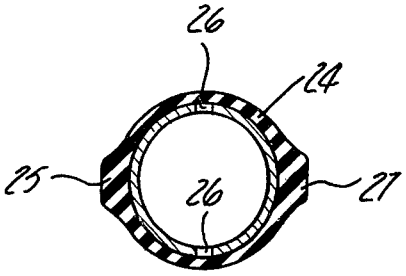
FIG. 8 is an enlarged fragmentary view of a tube-sleeve assembly used in the FIG. 6 embodiment.

FIG. 5 illustrates the general condition of an elastomeric sleeve prior to its initial insertion on the associated tube 22. As shown, the sleeve has a circular cross section with a diameter less than the major diameter of the elliptical tube. When the sleeve is inserted onto the tube it is stretched or deformed to thus tightly encircle the tube. This stresses the tube for proper response to varying internal pressure conditions.

Figure 4:
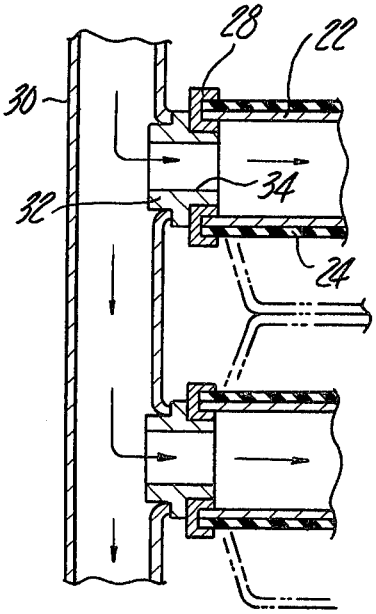
FIG. 4 shows a structural detail of the FIG. 2 shutter, taken along line 4—4.

The tubes 22 and associated sleeves 24 can be mounted between headers 30 and **30*a* in various ways. FIG. 4 illustrates a mounting connection at the inlet end of each tube; a similar connection would be provided at the outlet end of each tube. As shown, the inlet header 30 (extending between rails 31 and 33) is formed with circular openings that receive end pieces 32 for the associated tubes 22. Each end piece includes a circular section having a press fit in the header 30 opening, and an elliptical section having a press fit within a collar 28 carried by tube 22. The annular collars 28 have channel cross sections for tightly sealing the elastomeric sleeves to the tubes around the elliptical joints. Each flow passage from header 30 into a tube 22 may be provided by a drilled hole 34 in the associated end piece. As previously noted, the non-illustrated end of each tube 22 may be connected to a return header 30*a*** (FIG. 1) by a similar connector mechanism.

Each drilled hole in the non-illustrated end piece 32 is preferably smaller than the hole 34 at the inlet end of the tube, whereby the downstream hole provides a flow restriction that enables the supply pressure in header 30 to be appreciably greater than the return pressure in the outlet header **30*a***. The pressure drop between headers 30 and 30*a* provides the pressure energy that produces outward ballooning of the elastomeric sleeves 24.

Figure 6:
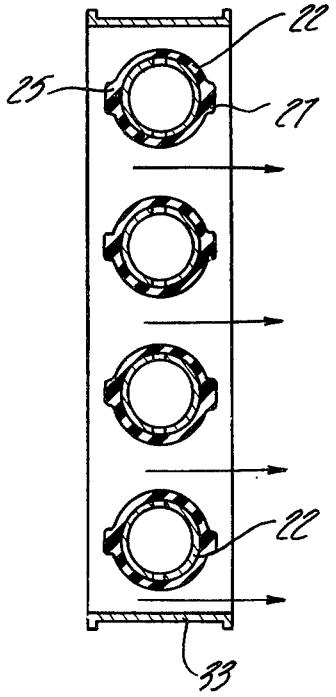
FIGS. 6 and 7 are similar to FIGS. 2 and 3 except that they illustrate another embodiment of the invention.
Figure 7:
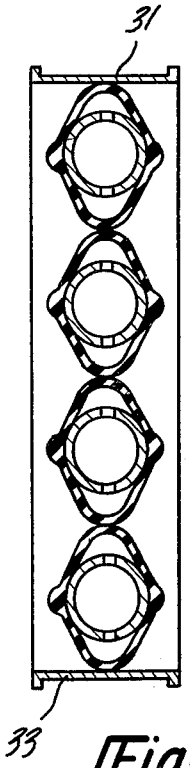

FIGS. 6 and 7 illustrate another embodiment of the invention wherein the rigid tubes 22 are circular rather than elliptical. The associated elastomeric sleeves 24 are also circular except that such sleeves are provided with thickened ribs 25 and 27 at their leading and trailing surfaces. The ribs extend along substantially the entire length of each elastomeric sleeve to provide local stiffening that lessens the elasticity in the rib areas. This rib construction, in cooperation with the "side" locations for ports 26, orients the sleeve balloon action transversely to the air stream rather than parallel to the air stream.

FIGS. 9 and 10 illustrate another embodiment of the invention, looking toward the face area of the shutter mechanism; the radiator (not shown) is located behind the illustrated shutter. The shutter includes a series of upstanding rigid tubes 22 connected solely to a supply header 30, i.e. there is no return header. The radiator air supply passage is defined by header 30 and a U-shaped frame 40 having an upper wall 42 and side walls 44. The left end 47 of header 30 is connected to a fluid pressure source such as compressed air; the right end of header 30 is plugged or closed. When the header-tube system is depressurized air may be drawn by fan 29 through spaces 46 defined by the outer surfaces of elastomeric tubes 24. When compressed air or other fluid is introduced into the open end 47 of header 30 the pressurized fluid fills the tubes 22 and spills through the flow ports 26 (not visible) to balloon the sleeves 24 outwardly (as shown in FIG. 10), thereby substantially closing the radiator air supply passage. The lower end of each elastomeric sleeve 24 is rigidly secured to the associated tube 24, as by means of a common hose clamp 48. The upper end area of each tube or sock 24 may be anchored between the upper closed end of the associated tube 22 and wall 42 of frame 40.

As previously noted, this invention is primarily useful in arctic military vehicles wherein shutters are necessary to prevent the radiator from overcooling the engine coolant after its passage out of the engine. The invention is advantageous over conventional shutters in that no external links, levers or pivots are employed. In conventional shutter mechanisms arctic ice-up conditions can produce a complete ice film on the external surfaces of the shutter, including the levers and links. Such an ice buildup provides a considerable resistance to actuation of the linkages, since the power to operate such linkages must simultaneously crack off and shed the entire ice buildup. In many cases it is not possible to achieve satisfactory operation of conventional shutter linkages, as for example during heavy sleet storms or snow storms.

The shutter of the present invention can operate by selective or sequential crack-off of ice accumulations on the exterior surfaces of the elastomeric sleeves 24. The internal pressure can initially balloon the elastomer outwardly at the points in registry with ports 26. Initial outward flexing of the elastomer cracks the ice film at localized points along the elastomer. Such localized cracks propagate along the elastomer surface to produce substantially complete shredding of the ice film from the operating surfaces of the elastomer, i.e. the sleeve side surfaces that move toward and away from one another to control air flow through the shutter.

Experimentation is required to produce the optimum port 26 size and spacing. The ports could be one or two rows of circular holes extending along each side surface of tube 22. Each port could be an elongated slot extending either longitudinally along or transversely around the tube 22 surface. Ordinarily the rear face area of the shutter mechanism would be more protected from the weather than the front face; therefore it might be desirable to locate at least some of the pressure ports 26 near the rear surface of tube 22 for propagation of ice crackage from the more protected areas toward the less protected areas.

I wish it to be understood that I do not desire to be limited to the exact details of construction shown and described for obvious modifications will occur to a person skilled in the art.

I claim:

1. In an arctic military vehicle having a liquid-cooled engine and an air-cooled radiator for cooling the coolant after its passage through the engine: the improvement comprising a shutter mechanism located in the supply air stream for the radiator to prevent overcooling of the coolant; said shutter mechanism comprising a plurality of rigid tubes extending transversely across the air stream, an elastomeric sleeve tightly encircling each tube along its entire length, means anchoring the ends of each sleeve to the ends of each associated tube, means for supplying pressurized fluid to each tube interior, and flow ports spaced along the length of each tube, whereby the pressurized fluid is caused to flow through the ports to balloon out the elastomeric sleeves, thereby reducing the air flow passage areas defined by exterior surfaces of said sleeves; each tube having an elliptical cross section oriented so that its major axis is parallel to the direction of the airstream; the flow ports in each tube being formed exclusively in laterally facing tube areas extending normal to the direction taken by the airstream, whereby the elastomeric sleeves are caused to balloon transverse to the airstream rather than parallel to the airstream.

* * * * *